US010333201B2

(12) United States Patent
O'Driscoll et al.

(10) Patent No.: US 10,333,201 B2
(45) Date of Patent: Jun. 25, 2019

(54) MULTI-ANTENNA WEARABLE DEVICE

(71) Applicant: Verily Life Sciences LLC, Mountain View, CA (US)

(72) Inventors: Stephen O'Driscoll, San Francisco, CA (US); Jiang Zhu, Cupertino, CA (US); Uei-ming Jow, San Jose, CA (US); Maryam Fathi, Palo Alto, CA (US)

(73) Assignee: VERILY LIFE SCIENCES LLC, South San Francisco, CA (US)

( * ) Notice: Subject to any disclaimer, the term of this patent is extended or adjusted under 35 U.S.C. 154(b) by 234 days.

(21) Appl. No.: 15/231,904

(22) Filed: Aug. 9, 2016

(65) Prior Publication Data

US 2018/0048055 A1 Feb. 15, 2018

(51) Int. Cl.

| | |
|---|---|
| ***H01Q 1/38*** | (2006.01) |
| ***H01Q 1/27*** | (2006.01) |
| ***H01Q 1/22*** | (2006.01) |
| ***H01Q 1/36*** | (2006.01) |
| ***H01Q 1/42*** | (2006.01) |
| ***H01Q 1/48*** | (2006.01) |
| ***H01Q 1/52*** | (2006.01) |
| ***H01Q 7/00*** | (2006.01) |
| ***H01Q 9/42*** | (2006.01) |
| ***H01Q 21/28*** | (2006.01) |

(52) U.S. Cl.

CPC ..... *H01Q 1/273* (2013.01); *H01Q 1/2208* (2013.01); *H01Q 1/2291* (2013.01); *H01Q 1/36* (2013.01); *H01Q 1/38* (2013.01); *H01Q 1/42* (2013.01); *H01Q 1/48* (2013.01); *H01Q 1/521* (2013.01); *H01Q 7/00* (2013.01); *H01Q 9/42* (2013.01); *H01Q 21/28* (2013.01)

(58) Field of Classification Search

CPC ..... H01Q 1/48; H01Q 1/521; H01Q 21/28

See application file for complete search history.

(56) References Cited

U.S. PATENT DOCUMENTS

| | | | | |
|---|---|---|---|---|
| 8,786,497 | B2 * | 7/2014 | Sharawi | H01Q 1/38 343/700 MS |
| 2012/0212386 | A1 | 8/2012 | Massie et al. | |
| 2015/0269400 | A1 | 9/2015 | Poussot et al. | |

FOREIGN PATENT DOCUMENTS

| | | |
|---|---|---|
| EP | 2581887 | 4/2013 |
| EP | 3001503 | 3/2016 |

OTHER PUBLICATIONS

International Patent Application No. PCT/US2017/042184 , "International Search Report and Written Opinion", dated Oct. 19, 2017, 14 pages.

* cited by examiner

*Primary Examiner* — Graham P Smith

(74) *Attorney, Agent, or Firm* — Kilpatrick Townsend & Stockton LLP

(57) ABSTRACT

A multi-antenna device may include a high-frequency antenna, a low-frequency antenna, and a patterned metal ground plane defining channels having capacitors operable a short circuit for the high-frequency antenna and an open-circuit for the low-frequency antenna. The high-frequency antenna, the low-frequency antenna, and the patterned metal ground plane may be coupled to a multi-layer printed circuit board of the multi-antenna device. The channels of the metal ground plane conductor may have dimensions to, themselves, operate as the capacitors. In other aspects, discrete capacitors may be positioned on the metal ground plane proximate to the channels to reduce eddy currents during operation of the low-frequency antenna.

31 Claims, 7 Drawing Sheets

MULTI-ANTENNA WEARABLE DEVICE

TECHNICAL FIELD

The present disclosure generally relates to multi-antenna devices, and, more particularly, although not necessarily exclusively, to using a common ground plane conductor for multiple antennas.

BACKGROUND

As electronic devices decrease in size, the area on a printed circuit board to configure electronic components of the electronic device becomes increasingly limited. The limited area may affect electronic devices including multiple antennas for multi-band communication with external systems and devices. For example, different antennas may have different layout requirements, and using multiple different antennas in a single device may affect the size of the device.

SUMMARY

In some aspects of the present disclosure, a monitoring device may include a high-frequency antenna and a low-frequency antenna operable in different frequency ranges to wirelessly communicate biological measurements obtained by a sensor to an external computing device proximate to the monitoring device. The monitoring device may include a metal ground plane conductor formed on a printed circuit board within a housing of the monitoring device. The metal ground plane conductor may include a contiguous metal surface that defines channels corresponding to gaps in the contiguous metal surface. To reduce eddy currents caused by the metal ground plane conductor during low-frequency communication, each of the channels may include at least one capacitor acting as an open circuit when the low-frequency antenna is operating in a low-frequency range. In some aspects, the channels may be dimensioned to, themselves, act as the capacitor. In other aspects, discrete capacitors may be positioned on the metal ground plane conductor spanning opposite sides of the channels.

In one aspect, a wearable monitoring device comprises a housing. The wearable monitoring device also comprises a PCB disposed in the housing and including a first wireless communication device and a second wireless communication device disposed on the PCB. The wearable monitoring device also comprises a biological sensor communicatively coupled to the PCB. The wearable monitoring device also comprises a first antenna communicatively coupled to the first wireless communication device and tuned for a first frequency range. The wearable monitoring device also comprises a second antenna communicatively coupled to the second wireless communication device and tuned for a second frequency range. The wearable monitoring device also comprises a ground plane conductor disposed on the PCB and including a contiguous metal surface defining a plurality of channels extending inward from a perimeter of the contiguous metal surface. The wearable monitoring device also comprises at least one capacitor for each of the channels. Each capacitor is sized to operate substantially as a short circuit in the first frequency range and to operate substantially as an open circuit in the second frequency range. The first frequency range and the second frequency range do not overlap.

In another aspect, a method includes providing a printed circuit board ("PCB"). The method also includes forming a ground plane conductor on the PCB. The ground plane conductor has a contiguous metal surface defining one or more channels extending inward from a perimeter of the contiguous metal surface. The channels are gaps in the contiguous metal surface of the ground plane conductor. The method also includes forming a high-frequency antenna and a low-frequency antenna. The high-frequency antenna is tuned for a first frequency range and the low-frequency antenna tuned for a second frequency range that does not overlap the first frequency range. The method also includes communicatively coupling the high-frequency antenna to the ground plane conductor.

In another aspect, a method includes attaching a monitoring device to skin of a patient. The monitoring device includes a sensor and a multi-antenna device coupled to a PCB. The multi-antenna device includes a high-frequency antenna tuned for a first frequency range, a low-frequency antenna tuned for a second frequency range, and a ground plane conductor having a contiguous metal surface defining a plurality of channels. The plurality of channels are gaps in the metal surface of the ground plane conductor. The plurality of channels are operable substantially as a short circuit in the first frequency range and operable substantially as an open circuit in the second frequency range. The method also includes positioning a computing device within coupling range of the monitoring device. The method also includes using the computing device to wirelessly communicate with the monitoring device to obtain information from the sensor using one of the high-frequency or low-frequency antennas.

These illustrative examples are mentioned not to limit or define the scope of this disclosure, but rather to provide examples to aid understanding thereof. Illustrative examples are discussed in the Detailed Description, which provides further description. Advantages offered by various examples may be further understood by examining this specification.

BRIEF DESCRIPTION OF THE DRAWINGS

The accompanying drawings, which are incorporated into and constitute a part of this specification, illustrate one or more certain examples and, together with the description of the example, serve to explain the principles and implementations of the certain examples.

DETAILED DESCRIPTION

Figure 1A:
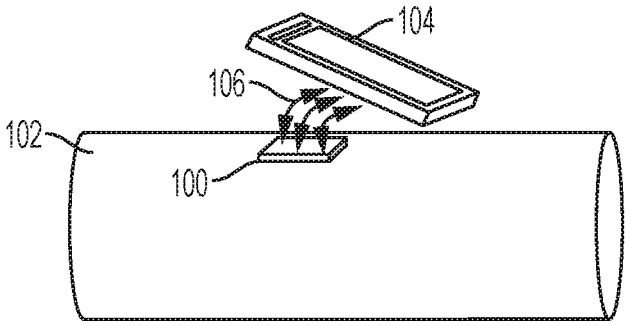
FIG. 1A is a graphical illustration of an example of a monitoring device communicatively coupled to a handheld device at a close range using a multi-antenna device according to some aspects of the present disclosure.

Certain aspects and examples of the present disclosure relate to compact devices having both high-frequency and low-frequency antennas proximate to a ground plane conductor disposed on a printed circuit board ("PCB"). In one example, a multi-antenna device includes a ground plane conductor, a low frequency antenna, and a high-frequency antenna. In this example, the ground plane conductor includes a metal surface that improves performance of the high-frequency antenna during high-frequency communications. But, the metal surface generates eddy currents that degrade the performance of the low-frequency antenna during low-frequency communications. Thus, to reduce the effect of eddy currents generated by the ground plane conductor during low-frequency communications, the ground plane conductor defines several channels that extend from the outer edge of the ground plane conductor towards its center. The widths of the channels have been sized to create a capacitance across each channel. The capacitances of the channels have been selected such that, during high-frequency transmission or reception, they operate as short circuit, thus apparently eliminating the channels. But at low frequencies, the capacitances operate as open circuits thereby reducing the apparent size of the ground plane conductor and reducing the impact of eddy currents.

While the illustrative example above sizes the channels to create suitable capacitances, in some aspects, multi-antenna devices may include a ground plane conductor defining channels that are bridged by one or more capacitors that have been sized to operate as a short circuit in a high-frequency range and an open circuit in a low-frequency range. A high-frequency antenna tuned for the high-frequency range and a low-frequency antenna tuned for the low-frequency range may be communicatively coupled to the PCB through the ground plane conductor to allow the multi-antenna device to communicate with external devices in both the high-frequency range and the low-frequency range. In some aspects, the ground plane conductor may include a contiguous, two-dimensional surface defining the channels. The channels may be non-intersecting and may extend inward from a perimeter of the ground plane conductor. In some aspects, the dimensions of the channels (e.g., size, shape) may be defined to act as a short circuit or open circuit during operation of the high-frequency antenna and the low-frequency antenna. For example, channels having a rectangular shape and a large surface area may provide greater capacitance to act as an open circuit at low frequencies and as a short circuit at high frequencies. In another example, channels having an interdigital, or crenellated, shape may provide similarly enhanced capacitance.

In some aspects, the multi-antenna device may serve as a wireless communication component of a device, such as a monitoring device. In some aspects, the monitoring device may include one or more invasive or non-invasive sensors. The sensors may be incorporated onto the same PCB as the multi-antenna device. In some aspects, the PCB may be a multilayer PCB to allow space to compact a greater number of components to the PCB without compromising a compact design of the monitoring device. In some aspects, the components of the multi-antenna device may be distributed within the PCB. For example, the high-frequency antenna may be positioned or disposed on, or otherwise in communication with, a first layer of the PCB, the low-frequency antenna may be positioned or disposed on, or otherwise in communication with, a second layer of the PCB, and the ground plane conductor may be positioned or disposed on, or otherwise in communication with, a third layer of the PCB.

Detailed descriptions of certain examples are discussed below. These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples but, like the illustrative examples, should not be used to limit the present disclosure. The various figures described below depict examples of implementations for the present disclosure, but should not be used to limit the present disclosure.

Figure 1B:
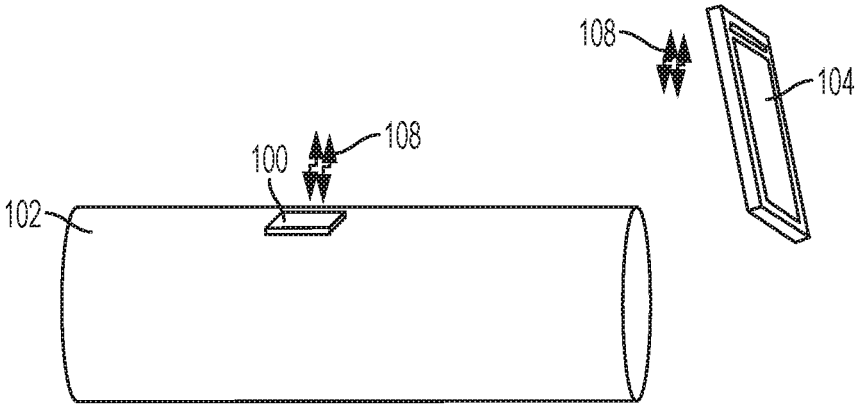
FIG. 1B is a graphical illustration of the monitoring device communicatively coupled to the handheld device at a greater range using the multi-antenna device according to some aspects of the present disclosure.

Various aspects of the present disclosure may be implemented for wireless communication in various scenarios. FIGS. 1A and 1B illustrate a monitoring device 100 positioned on human skin 102. In some aspects, the monitoring device 100 may be a biomedical device for measuring biological parameters of a patient, such as glucose levels of a diabetic patient. For example, the monitoring device 100 may be a wearable device attached to the skin 102 of a patient by an adhesive layer on the monitoring device's 100 housing, a band (not shown), interference between an injected sensor and the skin 102 (for invasive monitoring devices), or by other suitable attaching means. In another example, the monitoring device 100 may be an implantable device implanted into the skin 102. In some aspects, the monitoring device 100 may include one or more invasive or non-invasive sensor devices for measuring the biological parameters of a patient and may use the multi-antenna device according to aspects of the present disclosure to communicate the parameter measurements to an external device 104.

The monitoring device 100 may be compact in size for placement on the patient's skin 102. In some aspects, the compact nature of the monitoring device 100 may allow for the monitoring device 100 to remain on the skin 102 for an extended period of time to continuously monitor the biological parameters of the patient with minimal discomfort. For example, the monitoring device 100 may be positioned on a patient's arm and remain in place on the arm for several days to provide measurements of the patient's biological parameters at regular intervals (e.g., every minute, every hour, etc.). The monitoring device's 100 compact nature may also provide an increased number of areas on the patient's skin 102 that the monitoring device 100 may be placed. For example, the monitoring device 100 may be sized for placement on the skin 102 of a patient's limb, such as an arm or leg, or on a patient's stomach. In other examples, the monitoring device 100 may be sufficiently compact for placement on a smaller body part, such as a patient's hand or finger. In some aspects, the monitoring device 100 may include a housing having a circular or other rounded cross-sectional shape and having a diameter (or diameter-like measurement through the center of the shape for non-circular, rounded shapes) measuring less than approximately 2 inches (or approximately 5 centimeters). Similarly, in another example, the monitoring device's 100 housing may have a polygonal shape with a width or length measuring less than approximately 2 inches (or approximately 5 centimeters).

In some aspects, the external device 104 may include a computing device having one or more antenna devices compatible with the multi-antenna device of the monitoring device 100 for allowing wireless communication between the monitoring device 100 and the external device 104. In some aspects, the external device 104 may be a handheld computing device, such as a smartphone, personal digital assistant, or tablet. In other aspects, the external device 104 may represent any computing device having communication means for wireless communication, such as RFID, NFC, BlueTooth, or a wireless local area network (WLAN) device, with the monitoring device 100, including, but not limited to a desktop computer, a laptop, or a wearable device (e.g., a smartwatch). In additional and alternative aspects, the external device 104 may include a processor for analyzing measurements transmitted from the monitoring device 100 and/or a database for storing such measurement.

In FIG. 1A, the external device 104 is shown as positioned in short-range proximity to the monitoring device 100. Arrows 106 represent a communicative coupling of the monitoring device 100 and the external device 104 for wireless communication between the devices. In some aspects, the coupling range for communicatively coupling the monitoring device 100 and the external device 104 may include a proximity between 0 and 25 centimeters. Such a range may be suitable for certain short-range communication technologies, such as RFID or NFC, using a low-frequency antenna. In FIG. 1B, the external device 104 is shown as positioned farther away from the monitoring device 100 than the external device 104 shown in FIG. 1A. Arrows 108 represent a communicative coupling of the monitoring device 100 and the external device 104 for wireless communication at a farther range. In some aspects, the coupling range for communicatively coupling of the monitoring device 100 and the external device 104 include a proximity between 0 and 120 meters. While in some examples, RFID and NFC may not be capable of communicating over longer ranges, other communication technologies may be used, such as BlueTooth or WiFi, which may use a high-frequency antenna. In some aspects, the frequency at which the monitoring device 100 may wirelessly communicate with the external device 104 may be directly proportional to the coupling range between the devices 100, 104. For example, the communicative coupling of the monitoring device 100 and the external device 104 at a short-range proximity as depicted by the arrows 106 may allow for communication at a lower frequency than the frequency of communication between the monitoring device and the external device 104 coupled at the greater range, as depicted by the arrows 108. In some aspects, the multi-antenna device may include multiple antennas, each configured for wireless communication at varying frequency ranges. The multiple antennas may allow the multi-antenna device to facilitate wireless communication at both the short-range proximity depicted by the arrows 106 and the longer-range proximity depicted by the arrows 108

Figure 2A:
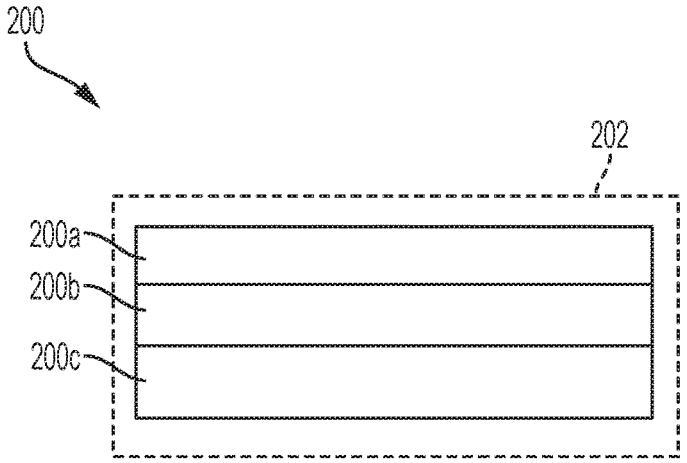
FIG. 2A is a cross-sectional side view of a printed circuit board supporting a multi-antenna device according to some aspects of the present disclosure.
Figure 2B:
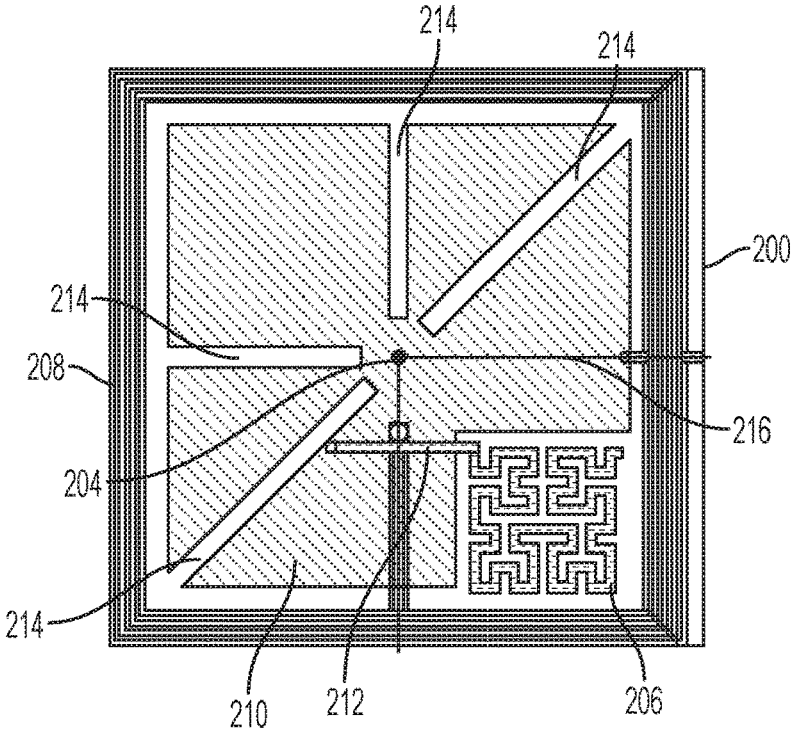
FIG. 2B is a semi-transparent top-down view of a multi-device antenna disposed on the printed circuit board of FIG. 2A according to aspects of the present disclosure.

FIGS. 2A and 2B depict a PCB 200 that may incorporate the electrical components of the monitoring device 100 of FIGS. 1A and 1B according to some aspects. FIG. 2A is a cross-sectional side view of the PCB 200 and FIG. 2B shows a multi-device antenna disposed on the PCB 200. The PCB 200 may be internal to a housing 202 of the monitoring device 100. In some aspects, the housing 202 may serve as the housing for all components of the monitoring device 100 of FIG. 1. In other aspects, the housing 202 may house only the PCB 200 and subset of monitoring device 100 components that are physically disposed on the PCB 200. Although the housing 202 is depicted in FIG. 2A as having a rectangular cross-sectional shape, the housing 202 may have any shape without departing from the scope of the present disclosure. For example, the housing 202 may have a rounded surface, a flat surface, or another non-rectangular cross-sectional shape. The housing 202 may be made of any suitable material for housing the PCB 200. Non-limiting examples of materials that may be suitable for the housing 202 include molding material, polyethylene, polyvinyl chloride ("PVC"), polypropylene, nylon, polyurethane, polycarbonate, steel, aluminum, and other materials for forming the housing. In some aspects, at least one surface of the housing 202 may be thin to allow radio frequencies from the multi-antenna device to be transmitted to and received from wireless communication devices external to the housing 202.

In this example, the PCB 200 is a multi-layer PCB including three layers 200*a-c* as shown in FIG. 2A. Each layer 200*a-c* may include conductive traces, or other features etched into the surface, to incorporate the monitoring device's 100 electrical components. In some aspects, each layer 200*a-c* may include etched features on the surface of one or both sides of the respective layer. Although the layers 200*a-c* are shown in FIG. 1 as positioned against each other, in some aspects, the layers 200*a-c* may include space, insulation, or other material between each layer 200*a-c*. Although three layers 200*a-c* are shown, the PCB 200 may include any number of layers, including a single layer PCB, without departing from the scope of the present disclosure.

FIG. 2B also shows components of a multi-antenna device disposed on the layers 200*a-c* of the multi-layer PCB 200. In this example, the multi-antenna device includes two antennas, a high-frequency antenna 206 and a low-frequency antenna 208. The high-frequency antenna 206 may be communicatively coupled to a wireless communication device disposed on the PCB 200. The high-frequency antenna 206 may be tuned for transmitting or receiving radio signals at a frequency range that is higher than, and does not overlap with, the frequency range at which the low-frequency antenna is tuned. In some aspects, the frequency range for the high-frequency antenna 206 may be at least one order of magnitude, or 10 times, greater than the frequency range for the low-frequency antenna. For example, the high-frequency antenna 206 according to some aspects may be tuned for radio frequency signals in a range of 0.5 GHz to 10 GHz. Non-limiting examples of the high-frequency antenna 206 include a Bluetooth antenna, Bluetooth low energy ("BLE") antenna, Long-Term Evolution ("LTE"), a wireless local access network ("WLAN") antenna, or other suitable means for transmitting higher-frequency radio signals. For example, the high-frequency antenna 206 of the multi-antenna device may include a Bluetooth or BLE antenna tuned for a frequency of 2.4 GHz. In another example, the high-frequency antenna 206 may include a WLAN antenna tuned for a frequency of 2.4 GHz, 5 GHz, or 5.8 GHz.

The low-frequency antenna 208 may be communicatively coupled to a second wireless communication device disposed on the PCB 200. The low-frequency antenna 208 may be tuned for radio frequency signals in the range of 100 kHz to 100 MHz. Non-limiting examples of the low-frequency antenna 208 include a near-field communication ("NFC") antenna, a radio-frequency identification ("RFID") antenna, or other suitable means for transmitting radio signals at lower frequencies. For example, the low-frequency antenna 208 may include a NFC antenna tuned for a frequency of 13.56 MHz. In another example, the low-frequency antenna 208 may include an RFID antenna tuned for a frequency range of 120-150 kHz. In other examples, the low-frequency antenna 208 may include an RFID antenna tuned for a frequency range of 13.56 MHz or 433 MHz.

The multi-antenna device also includes a ground plane conductor 210. The ground plane conductor 210 may include a conductive surface that is connected to a ground terminal of a power supply. The ground plane conductor 210 may be accessible to each of the electrical components on the PCB 200 and may serve as a return path for current from each of the components. In some aspects, the ground plane conductor 210 may include a metal material, such as copper. In additional aspects, the ground plane conductor 210 may also include a ferrite material or other suitable means to reduce the eddy current generated by the metal material during operation of the multi-antenna device at lower frequencies through the low-frequency antenna 208. The ground plane conductor 210 may have a planar shape and be positioned or disposed on a large surface area of the PCB 200 to allow each of the components access to the circuit board without having to use long traces or component leads. In some aspects, the surface area of the ground plane conductor 210 may cover all or a majority of one of the layers 200*a-c* of the PCB 200. In some aspects, the high-frequency antenna 206 may be physically and communicatively coupled to the ground plane conductor 210 by a component lead. For example, the high-frequency antenna 206 is connected to the ground plane conductor 210 by lead wire 212. The lead wire 212 may extend from the high-frequency antenna 206 to the ground plane conductor 210.

To reduce ground plane conductor interference with low-frequency communication (e.g., interference caused by eddy currents), the ground plane conductor 210 may include a contiguous metal surface that defines channels 214 in the ground plane conductor 210. The channels 214 may be dimensioned to operate as a short circuit during high-frequency wireless communication between the multi-antenna device and an external device, through the high-frequency antenna 206. For example, the size, shape, or position of the channels 214 may allow them to operate as the short circuit, effectively eliminating the channels 214 during high-frequency transmission. At low-frequencies, the dimensions of the channels 214 may allow the channels 214 to operate as an open circuit during wireless communication between the multi-antenna device and the external device at lower frequencies through the low-frequency antenna. In some aspects, the open-circuit operation may prevent current flow across the ground plane conductor 210 during low-frequency communication to reduce the eddy current caused by the metal material of the ground plane conductor 210. The desired specification of the channels may correspond to the size, shape, or position of the channels 214 that balances the efficiency in wireless communication for both the high-frequency antenna 206 and the low-frequency antenna 208.

In some aspects, a channel 214 may be defined by a contiguous metal portion of the ground plane conductor 210. As such, the channels 214 may not extend through the ground plane conductor 210 to entirely physically separate the ground plane conductor 210 into multiple discrete sections. In FIG. 2B, each channel 214 has a rectangular shape and extends from an edge of the ground plane conductor 210 toward the center 204 of the ground plane conductor 210. Although four channels 214 are shown in FIG. 2B, the ground plane conductor 210 may include any number of channels 214, including only one. Further, while the channels 214 in this example are formed as straight lines extending from the edge of the ground plane conductor 210 towards the center 204, other arrangements may be employed. For example, one or more channels 214 may be formed extending perpendicularly from the edge of the ground plane conductor 210, but need not be directed towards the center 204. For example, multiple channels may be formed extending one edge of the ground plane conductor 210 to create a comb shape.

In one aspect, the high-frequency antenna 206 may have a planar shape corresponding to the layer 200*a-c* of the PCB 200 on which the high-frequency antenna 206 is disposed. The high-frequency antenna 206 includes a patterned trace to form a square shape, although other patterns and shapes are possible without departing from the scope of the present disclosure. The high-frequency antenna 206 is communicatively coupled to the ground plane conductor, which may be on the same layer or a different layer of the PCB 200. In addition, the high-frequency antenna may further be communicatively coupled to a circuit or processor, such as a BlueTooth or WLAN transmitter or receiver, to enable wireless transmission or reception of data using the high-frequency antenna.

The low-frequency antenna 208 may be formed along the outer edge of the PCB 200. In some aspects, the high-frequency antenna 206 may be positioned within a boundary of the low-frequency antenna 208 defined by the perimeter of the low-frequency antenna 208. In some aspects, the high-frequency antenna 206 and the low-frequency antenna 208 may be positioned on the same layer 200*a-c* of the PCB 200. In other aspects, the antennas 206, 208 may be positioned on separate layers 200*a-c*. For purposes of the present disclosure, the boundary of the low-frequency antenna 208 in relation to the position of the high-frequency antenna may refer to a physical boundary created by the perimeter of the low-frequency antenna 208 on the same layer 200*a-c*, or may refer to a boundary extending perpendicularly from the physical boundary of the perimeter and through each layer 200*a-c* of the PCB. Further, in some aspects, the high-frequency antenna may be smaller than the low-frequency antenna, and may be positioned within the perimeter of the low-frequency antenna.

In some aspects, the low-frequency antenna 208 may also be disposed on the PCB 200. In other aspects, the low-frequency antenna 208 may be positioned on another surface physically separate from the PCB 200, such as an internal or external surface of the housing 202. A lead wire 216 may physically and communicatively couple the low-frequency antenna 208 to the PCB 200 or a component positioned or disposed on the PCB 200. For example, the low-frequency antenna 208 may be communicatively coupled to a wireless communication device, such as NFC or RFID transmitter or receiver, to enable wireless transmission or reception of data using the low-frequency antenna 208. In some aspects, the low-frequency antenna 208 may have a planar shape. For example, the low-frequency antenna 208 may be positioned or disposed on a layer 200*a-c* of the PCB 200 and have a planar shape corresponding to the layer. In some aspects, the low-frequency antenna 208 may have a spiral shape. In other aspects, the low-frequency antenna 208 may have a nonplanar shape, such as a coil. The cross-sectional shape of a spiral or coil may be polygonal, such as the rectangular shape of the low-frequency antenna 208 shown in FIG. 2B, or may be circular.

Figure 3:
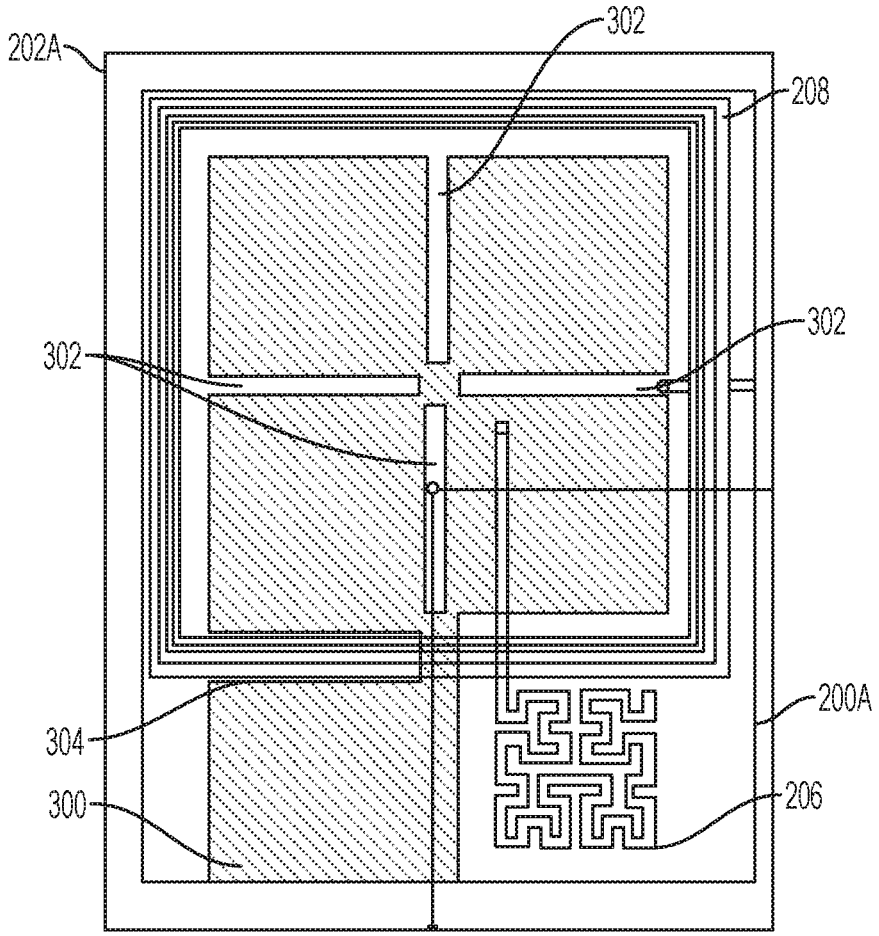
FIG. 3 is a semi-transparent view of an example configuration for a multi-antenna device disposed on a printed circuit board according to some aspects of the present disclosure.

FIG. 3 is a semi-transparent top-down view of another example PCB 200A for supporting a different configuration of the multi-antenna device according to some aspects of the present disclosure. The PCB 200A is disposed in a housing 202A. The PCB 200A and the housing 202A have a rectangular shape. The PCB 200A may incorporate a multi-antenna device having the same high-frequency antenna 206 and low-frequency antenna 208, but positioned in a different configuration than the PCB 200 and multi-antenna device of FIGS. 2A and 2B. For example, the high-frequency antenna 206 may be positioned outside the boundary defined by the perimeter of the low-frequency antenna 206. The low-frequency antenna 208 may be positioned on the same or a different layer of the PCB 200A than the high-frequency antenna 206, or may be positioned on an internal or external surface of the housing 202A. The multi-antenna device may also include a ground plane conductor 300 that is sized to span the length of the PCB 200A.

The ground plane conductor 300 surface defines channels 302. Similar to the channels 214 of FIG. 2B, the channels 302 may have dimensions to allow the channels 302 to operate as capacitors providing a short circuit during wireless communication between the multi-antenna device and an external device at higher frequencies through the high-frequency antenna 206. The dimensions of the channels 302 may also allow the channels 302 to operate as capacitors providing an open circuit during wireless communication between the multi-antenna device and the external device at lower frequencies through the low-frequency antenna 208. The channels 302 in the ground plane conductor 300 of FIG. may have a rectangular shape and may extend from an edge of the ground plane conductor 300 toward a center of the ground plane conductor 300. The channels 302 may not intersect with each other to allow the ground plane conductor 300 to include a single, contiguous metal surface. The channels 310 are positioned within the boundary of the perimeter of the low-frequency antenna 208. In some aspects, the proximity of the channels 310 to the low-frequency antenna 208 may further reduce the eddy current caused by the metal surface of the ground plane conductor 300 when the multi-antenna device is operating at lower frequencies through the low-frequency antenna 208.

The ground plane conductor 300 also defines an additional channel 304. The additional channel 304 may correspond to the position of the low-frequency antenna 208 overlapping the ground plane conductor 300. The channel 304 has a rectangular shape and extends across the ground plane conductor 300 in parallel with the ground plane conductor 300. The channel 304 does not extend the length of the ground plane conductor 300 such that the ground plane conductor 300 remains a contiguous metal surface. The position of the channel 304 allows the low-frequency antenna to overlap only a limited portion of the metal surface of the ground plane conductor 300, which may reduce the eddy currents produced by the metal portions during operation of the multi-antenna device at lower frequencies through the low-frequency antenna.

Figure 4:
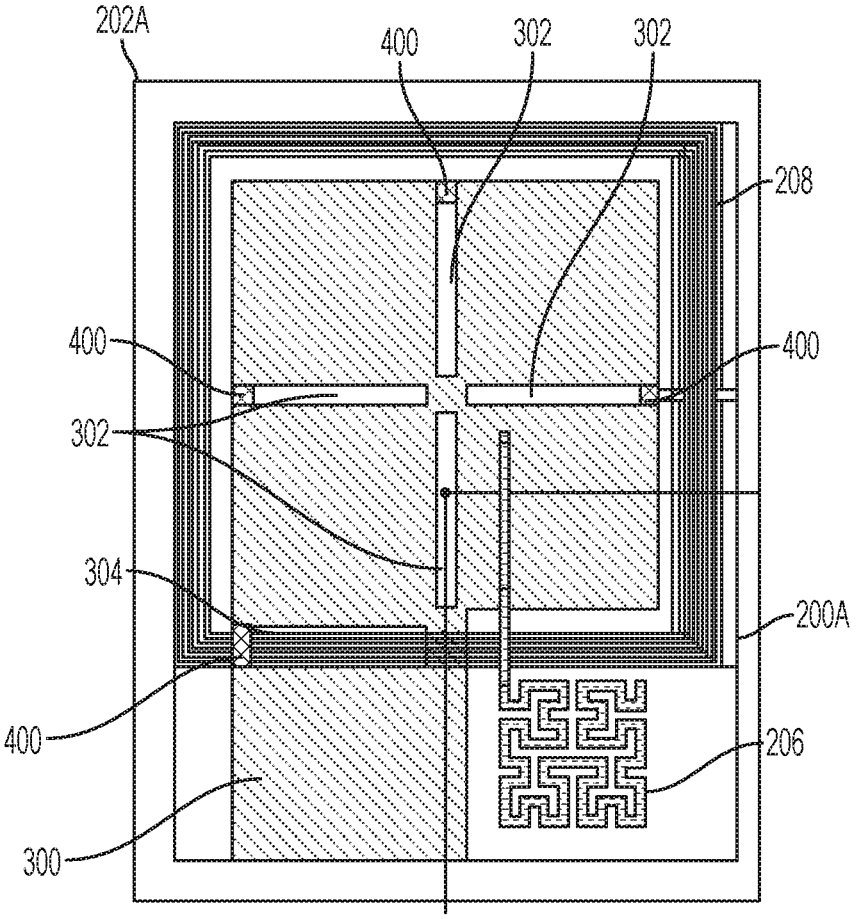
FIG. 4 is a semi-transparent top-down view of capacitors disposed on the ground plane conductor of a multi-antenna device according to some aspects of the present disclosure.

FIG. 4 is a semi-transparent top-down view of the PCB 200A including discrete capacitors 400 for an example multi-antenna device. The capacitors 400 are positioned or disposed on the ground plane conductor 300 such that the capacitors 400 span a width of the channels 302, 304 to couple the opposing edges of the capacitors 400 to the ground plane conductor 300. In some aspects, the capacitors 400 may operate as a short circuit when the multi-antenna device is operating in higher frequencies through the high-frequency antenna 206 and may operate as an open circuit when the multi-antenna device is operating in lower frequencies through the low-frequency antenna 208. Although four capacitors 400 are shown, one for each channel, any number of capacitors 400 may be used. In some aspects, the size of the capacitors 400 may depend on the frequency range of the high-frequency antenna 206 or the frequency range of the low-frequency antenna 208. In some examples, the capacitors 400 may be sized for a capacitance range between 0.1 pF and 100 pF.

Figure 5:
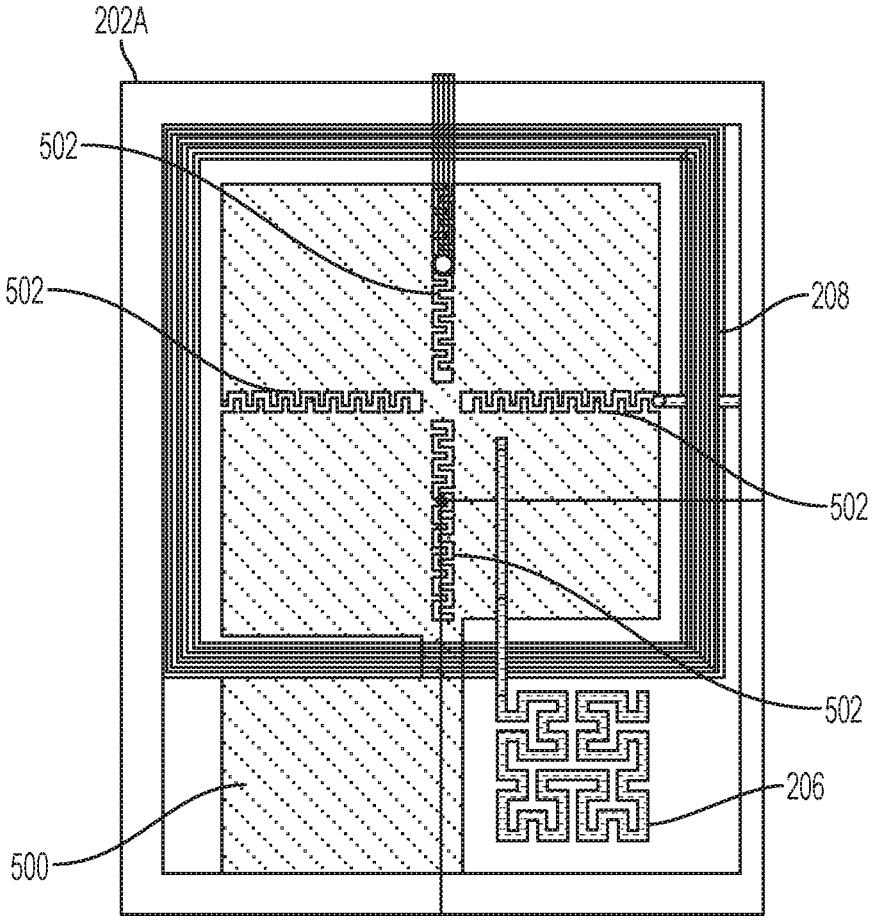
FIG. 5 is a semi-transparent top-down view of an example configuration for the ground plane conductor of a multi-antenna device according to some aspects of the present disclosure.

FIG. 5 is a semi-transparent top-down view of the PCB 200A including an alternative ground plane conductor 500 according to some aspects of the present disclosure. The low-frequency and high-frequency antennas may be positioned on the PCB 200A as described in FIGS. 3 and 4. Further, in this example, the ground plane conductor 500 defines channels 502 having different dimensions than the channels 302 of the ground plane conductor 300 shown in FIG. 3. The ground plane conductor 500 shown in FIG. 5 may include a contiguous metal surface defining an interdigital, or crenellated, shape for the channels 502 defined by finger-like projections extending from a surface of the ground plane conductor 500 adjacent to the channels 502. The crenellated shape of the channels 502 may enhance the capacitance of the channels 502 to operate as a short circuit when the multi-antenna device is operating in higher frequencies through the high-frequency antenna 206 and as an open circuit when the multi-antenna device is operating in lower frequencies through the low-frequency antenna 208. Further, use of such channels 502 may eliminate the need to incorporate discrete capacitors into the multi-antenna device as the channels 502 may provide the desired capacitance.

In this example, the channels 502 extend inward from an outer edge of the ground plane conductor 500. The channels 502 are defined on the ground plane conductor 500 within the boundary of the low-frequency antenna 208. Although four channels are shown having the crenellated shape, any number of channels 502 may be used without departing from the scope of the present disclosure. Also, though each channel 502 has a crenellated shape, the channels 502 may have other dimensions, such as a sinusoidal shape or other dimensional means for enhancing the capacitance of the channels 502.

Figure 6:
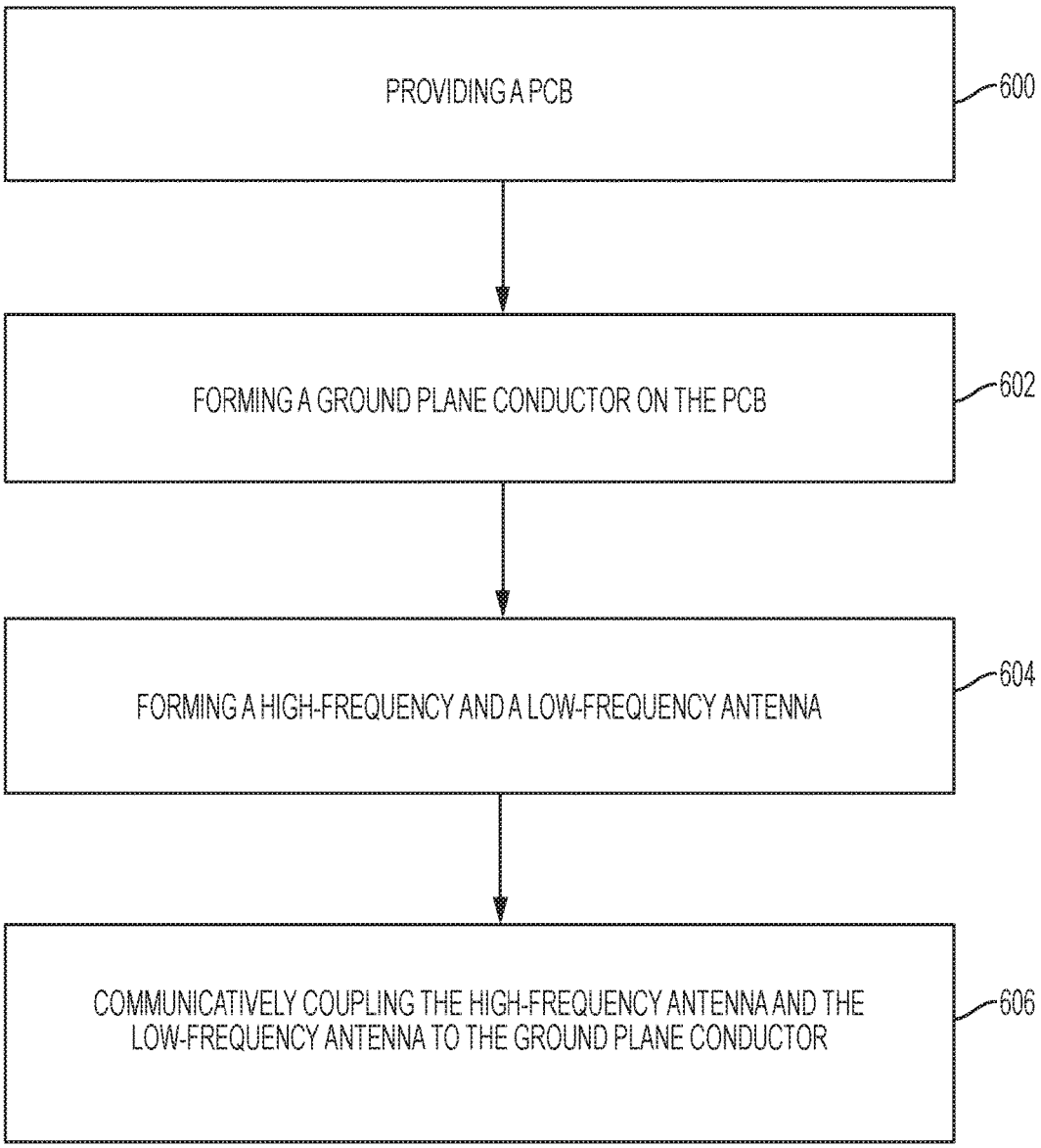
FIG. 6 is a flow chart of a process for manufacturing a multi-antenna device according to aspects of the present disclosure.

FIG. 6 is a flow chart of a process for manufacturing a multi-antenna device according to aspects of the present disclosure. The process is described with respect to the multi-antenna devices described in FIGS. 2A-5, unless otherwise indicated, though other implementations are possible without departing from the scope of the present disclosure.

In block 600, a PCB is provided. The PCB may be a single layer or may be a multi-layer PCB. For example, the PCB may include one of PCB 200 or PCB 200A. The PCB may include conductive tracks, or other features etched into the surface, to incorporate electrical components (e.g., one or more wireless communication devices) onto to the PCB.

In block 602, a ground plane conductor is formed including contiguous metal surface defining channels in the ground plane conductor. In some aspects, the ground plane conductor may include the ground plane conductor 210 including the channels 214 of FIG. 2B. In other aspects, the ground plane conductor may include the ground plane conductors 300, 500 of FIGS. 3-5. For example, the ground plane conductor may include one or more channels having a rectangular shape (e.g., channels 214, 302) or an interdigital shape (e.g., channels 502). The channels may have dimensions to allow the ground plane conductor to operate as a short circuit during wireless communication between the multi-antenna device and an external device at higher frequencies corresponding to the high-frequency antenna 206. The dimensions of the channels of the ground plane conductor may also allow the ground plane conductor to operate as an open circuit during wireless communication between the multi-antenna device and the external device at lower frequencies corresponding to the low-frequency antenna 208.

In some aspects, the dimensions of the channels may be determined prior to or during the fabrication of the ground metal plane. In one example, prior to fabricating the ground metal plane or disposing it on the PCB provided, simulations or calculations may be performed using known methods to determine a size, shape, and position for the ground metal plane. In some aspects, the desired dimensions or the channel may be determined based on the simulated or calculated efficiency of the high-frequency antenna 206 and the low-frequency antenna 208 provided using the ground metal plane. In some aspects, the desired dimensions of the channels may correspond to the size, shape, or position of the channels that balances the efficiency in wireless communication for both the high-frequency antenna 206 and the low-frequency antenna 208.

In block 604, the high-frequency antenna 206 and the low-frequency antenna 206 may be formed. The high-frequency antenna 206 may be any radio frequency antenna tuned to a frequency or frequency range that is at least one order of magnitude greater than the frequency or frequency range to which the low-frequency antenna 206 is tuned. For example, the high-frequency antenna may include a Bluetooth antenna tuned to a frequency of 2.4 GHz and the low-frequency antenna may be an NFC antenna tuned to a frequency of 13.56 MHz. In some aspects, the low-frequency antenna 208 may be disposed on the PCB 200. The low-frequency antenna 208 may be sized to include a perimeter around one or more edges of the PCB. In other aspects, the low-frequency antenna 208 may be disposed on an internal or external surface of the housing (e.g., housing 202 of FIG. 2) and may be coupled to the PCB via a lead wire (e.g., lead wire 216 of FIG. 2). The high-frequency antenna may be disposed on the surface of the PCB. In some aspects, the high-frequency antenna 206 may be positioned within the boundary of the low-frequency antenna 208 as shown in FIG. 2B. In other aspects, the high-frequency antenna 206 may be positioned external to the boundary of the low-frequency antenna 2 as shown in FIGS. 3-5.

In block 606, the high-frequency antenna 206 and the low-frequency antenna 208 may be coupled to the ground plane conductor 210. In some aspects, the high-frequency antenna 206 and the low-frequency antenna 208 may serve as a communication device for a monitoring device, such as the monitoring device 100 of FIG. 1. In some aspects, the ground plane conductor may be positioned on the PCB 200 to allow the channels defined by the ground plane conductor surface to be within a boundary of the perimeter of the low-frequency antenna 208 as shown in FIGS. 2B-5. In some aspects, capacitors may be coupled to the ground plane conductor. For example, the capacitors may be positioned over one or more of the channels of the ground plane conductor as shown in FIG. 4.

Figure 7:
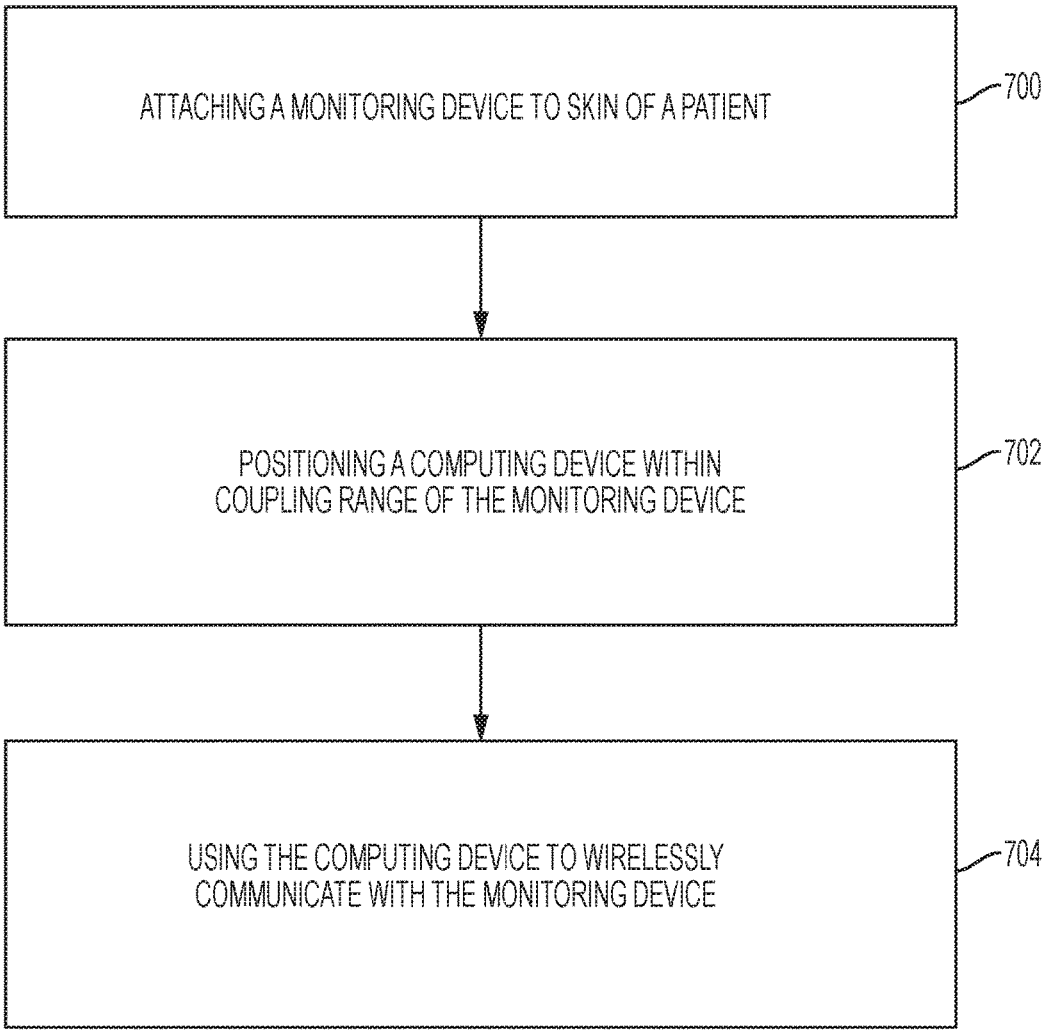
FIG. 7 is a flow chart of a process for using a monitoring device including a multi-antenna device according to aspects of the present disclosure.

FIG. 7 is a flow chart of a process for using a monitoring device including a multi-antenna device according to aspects of the present disclosure. The process is described with respect to the monitoring device 100 of FIGS. 1A and 1B and the multi-antenna devices described in FIGS. 2A-5, unless otherwise indicated, though other implementations are possible without departing from the scope of the present disclosure.

In block 700, the monitoring device 100 may be attached to a patient's skin 102. In some aspects, the monitoring device may be a wearable continuous glucose monitor. The monitoring device 100 may include a housing 202 in which a PCB 200 is disposed including one or more electrical components, such as invasive or non-invasive sensors, for measuring glucose levels of the patient at regular intervals, and a multi-antenna device including the high-frequency antenna 206, the low-frequency antenna 208, and a ground plane conductor (e.g., ground plane conductor 210, 300, 500). The ground plane conductor may include channels defined by a contiguous metal surface of the ground plane conductor (e.g., channels 214, 302, 304, 502).

In some aspects, the monitoring device 100 may be attached to the skin 102 via an adhesive layer on the housing 202 of the monitoring device 100. In other aspects, the monitoring device 100 may be attached to the skin by injecting an invasive sensor into the subcutaneous tissue of the skin 102.

In block 702, the external device 104 may be positioned within a coupling range of the monitoring device 100. In some aspects, the coupling range may be a close range to allow for communication between the monitoring device 100 and the external device 104 in the frequency range corresponding to the low-frequency antenna 208. For example, the external device 104 may be positioned within 25 cm of the monitoring device 100 (e.g., about 4 cm) to communicatively couple the low-frequency antenna 208 to a compatible antenna type positioned in the external device 104. In other aspects, the coupling range may be a longer range to allow for communication between the monitoring device 100 in the frequency range corresponding to the high-frequency antenna 206. For example, the monitoring device 100 may be positioned within 120 m of the external device 104 (e.g., about 100 m) to communicatively couple the high-frequency antenna 206 to a compatible antenna type positioned in the external device 104.

In block 704, the external device 104 may be used to wirelessly communicate with at least one of the high-frequency antenna 206 or the low-frequency antenna 208 to obtain information from the monitoring device 100. For example, the monitoring device 100 may wirelessly transmit measurements recorded by sensors coupled to the PCB in the frequency range corresponding to the high-frequency antenna 206 or the low-frequency antenna 208 depending, at least in part, on the proximity of the monitoring device 100 to the external device 104. The channels of the ground plane conductor coupled to the PCB may operate as a short circuit during a transmission by the multi-antenna device in the frequency range corresponding to the high-frequency antenna 206 and as an open circuit during a transmission by the multi-antenna device in the frequency range corresponding to the low-frequency antenna 208.

As discussed above, one or more suitable devices according to this disclosure may include a processor or processors. The processor may be in communication with a computer-readable medium, such as a random access memory (RAM) coupled to the processor. The processor executes computer-executable program instructions stored in memory. Such processors may comprise a microprocessor, a digital signal processor (DSP), an application-specific integrated circuit (ASIC), field programmable gate arrays (FPGAs), and state machines. Such processors may further comprise programmable electronic devices such as PLCs, programmable interrupt controllers (PICs), programmable logic devices (PLDs), programmable read-only memories (PROMs), electronically programmable read-only memories (EPROMs or EEPROMs), or other similar devices.

Such processors may comprise, or may be in communication with, media, for example computer-readable storage media, that may store instructions that, when executed by the processor, can cause the processor to perform the steps described herein as carried out, or assisted, by a processor. Examples of computer-readable media may include, but are not limited to, an electronic, optical, magnetic, or other storage device capable of providing a processor with computer-readable instructions. Other examples of media comprise, but are not limited to memory chips, ROM, RAM, ASICs, configured processors, or any other medium from which a computer processor can read. The processor, and the processing, described may be in one or more structures, and may be dispersed through one or more structures. The processor may comprise code for carrying out parts of one or more of the methods (or parts of methods) described herein.

The foregoing description of the examples, including illustrated examples, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention. The illustrative examples described above are given to introduce the reader to the general subject matter discussed here and are not intended to limit the scope of the disclosed concepts.

Reference herein to an example or implementation means that a particular feature, structure, operation, or other characteristic described in connection with the example may be included in at least one implementation of the disclosure. The disclosure is not restricted to the particular examples or implementations described as such. The appearance of the phrases "in one example," "in an example," "in one implementation," or "in an implementation," or variations of the same in various places in the specification does not necessarily refer to the same example or implementation. Any particular feature, structure, operation, or other characteristic described in this specification in relation to one example or implementation may be combined with other features, structures, operations, or other characteristics described in respect of any other example or implementation.

Use herein of the word "or" is intended to cover inclusive and exclusive OR conditions. In other words, A or B or C includes any or all of the following alternative combinations as appropriate for a particular usage: A alone; B alone; C alone; A and B only; A and C only; B and C only; and A and B and C.

What is claimed is:

1. A device, comprising:

a printed circuit board ("PCB");

a ground plane conductor disposed on the PCB, the ground plane conductor including a contiguous metal surface defining one or more channels extending inward from a perimeter of the contiguous metal surface, the channels being gaps in the contiguous metal surface of the ground plane conductor;

a high-frequency antenna coupled to the ground plane conductor and tuned for a first frequency range;

a low-frequency antenna coupled to the PCB and tuned for a second frequency range, wherein the first and second frequency ranges do not overlap; and at least one capacitor for each of the channels, each capacitor sized to operate substantially as a short circuit in the first frequency range and substantially as an open circuit in the second frequency range.

2. The device of claim 1, wherein the at least one capacitor spans a respective channel and is physically coupled to the ground plane conductor on opposite sides of the respective channel.

3. The device of claim 1, at least one channel of the one or more channels itself is the at least one capacitor and is dimensioned to operate substantially as the short circuit in the first frequency range and substantially as the open circuit in the second frequency range.

4. The device of claim 1, wherein the first frequency range is at least one order of magnitude greater than the second frequency range.

5. The device of claim 1, further comprising a housing, and wherein:

the PCB is disposed within the housing, the high-frequency antenna is disposed within the housing, and the low-frequency antenna is positioned on an external surface of the housing and is coupled to a lead wire, the lead wire coupling the low-frequency antenna to the PCB.

6. The device of claim 1, wherein the PCB is a multi-layer PCB, wherein the high-frequency antenna is positioned on a first layer of the multi-layer PCB, wherein the low-frequency antenna is positioned on a second layer of the multi-layer PCB, and wherein the ground plane conductor is positioned on a third layer of the multi-layer PCB.

7. The device of claim 1, wherein the one or more channels have one of a rectangular shape or a crenelated shape.

8. The device of claim 1, wherein the high-frequency antenna is one of a Bluetooth antenna, a Bluetooth low energy antenna, or a wireless local access network (WLAN) antenna.

9. The device of claim 1, wherein the low-frequency antenna is one of a radio-frequency identification ("RFD") antenna or a near-field communication ("NFC") antenna.

10. The device of claim 1, wherein the ground plane conductor includes a ferrite material.

11. The device of claim 1, wherein the first frequency range is within a first range of 0.5 gigahertz to 10 gigahertz, and wherein the second frequency range is within a second range of 100 kilohertz to 100 megahertz.

12. A wearable monitoring device, comprising:

a housing;

a printed circuit board ("PCB") disposed in the housing and including a first wireless communication device and a second wireless communication device disposed on the PCB;

a biological sensor communicatively coupled to the PCB;

a first antenna communicatively coupleable to the first wireless communication device and tuned for a first frequency range;

a second antenna communicatively coupleable to the second wireless communication device and tuned for a second frequency range;

a ground plane conductor disposed on the PCB and including a contiguous metal surface defining a plurality of channels extending inward from a perimeter of the contiguous metal surface, the plurality of channels being gaps in the contiguous metal surface; and at least one capacitor for at least one channel of the plurality of channels, each capacitor sized to operate substantially as a short circuit in the first frequency range and substantially as an open circuit in the second frequency range, wherein the first frequency range and the second frequency range do not overlap.

13. The wearable monitoring device of claim 12, wherein the at least one capacitor spans a respective channel of the plurality of channels and is physically coupled to the ground plane conductor on opposite sides of the respective channel.

14. The wearable monitoring device of claim 12, wherein the at least one channel of the plurality of channels itself is the at least one capacitor and is dimensioned to operate substantially as the short circuit in the first frequency range and substantially as the open circuit in the second frequency range.

15. The wearable monitoring device of claim 12, wherein the PCB includes:

a first layer on which the first antenna is disposed, a second layer on which the second antenna is disposed, and a third layer on which the ground plane conductor is disposed.

16. The wearable monitoring device of claim 12, wherein the ground plane conductor is coupled to the second antenna by a lead wire extending through the housing, wherein the second antenna is disposed on an external surface of the housing.

17. The wearable monitoring device of claim 12, wherein the plurality of channels have one of a rectangular shape or a crenelated shape.

18. The wearable monitoring device of claim 12, wherein the ground plane conductor includes a ferrite material to reduce eddy currents in the second frequency range.

19. The wearable monitoring device of claim 12, wherein the first frequency range is at least one order of magnitude greater than the second frequency range.

20. A method, including:

providing a printed circuit board ("PCB");

forming a ground plane conductor on the PCB, the ground plane conductor having a contiguous metal surface defining one or more channels extending inward from a perimeter of the contiguous metal surface, the one or more channels being gaps in the contiguous metal surface of the ground plane conductor, wherein the one or more channels comprise at least one capacitor sized to operate substantially as a short circuit in a first frequency range and substantially as an open circuit in a second frequency range that does not overlap the first frequency range;

coupling a high-frequency antenna and a low-frequency antenna to the ground plane conductor, the high-frequency antenna tuned for the first frequency range and the low-frequency antenna tuned for the second frequency range; and communicatively coupling the high-frequency antenna to the ground plane conductor.

21. The method of claim 20, further comprising coupling the at least one capacitor to the ground plane conductor to span at least one channel of the one or more channels and physically couple opposite edges of the at least one capacitor to the ground plane conductor.

22. The method of claim 20, wherein at least one channel of the one or more channels itself is the at least one capacitor and is dimensioned to operate substantially as the short circuit in the first frequency range and substantially as the open circuit in the second frequency range.

23. The method of claim 20, wherein the PCB is a multi-layer PCB including a first layer, a second layer, and a third layer, wherein the ground plane conductor is formed on the first layer, the high-frequency antenna is formed on the second layer, and the low-frequency antenna is formed on the third layer.

24. The method of claim 20, further comprising:

disposing the PCB in a housing;

positioning the low-frequency antenna on the housing; and communicatively coupling the low-frequency antenna to the PCB using a lead wire extending from the PCB to the low-frequency antenna.

25. The method of claim 20, wherein at least one of the one or more channels has a crenelated shape.

26. The method of claim 20, wherein the first frequency range is within a first range of 0.5 gigahertz to 10 gigahertz, and wherein the second frequency range is within a second range of 100 kilohertz to 100 megahertz.

27. A method, comprising:

attaching a monitoring device to skin of a patient, the monitoring device including a sensor and a multi-antenna device coupled to a printed circuit board ("PCB"), the multi-antenna device including a high-frequency antenna tuned for a first frequency range, a low-frequency antenna tuned for a second frequency range, and a ground plane conductor having a contiguous metal surface defining a plurality of channels, the plurality of channels being gaps in the metal surface of the ground plane conductor, wherein the plurality of channels are operable substantially as a short circuit in the first frequency range and operable substantially as an open circuit in the second frequency range;

positioning a computing device within coupling range of the monitoring device; and using the computing device to wirelessly communicate with the monitoring device to obtain information from the sensor using one of the high-frequency or low-frequency antennas.

28. The method of claim 27, wherein the coupling range is between 0 meters and 120 meters in the first frequency range and 0 cm and 25 cm within the second frequency range.

29. The method of claim 27, wherein the monitoring device is a continuous glucose monitor.

30. The method of claim 27, wherein the first frequency range is within a first range of 0.5 gigahertz to 10 gigahertz, and wherein the second frequency range is within a second range of 100 kilohertz to 100 megahertz.

31. The method of claim 27, wherein at least one of the plurality of channels has a rectangular or a crenelated shape.

* * * * *